United States Patent [19]

Lambly et al.

[11] 3,998,492

[45] Dec. 21, 1976

[54] METHOD FOR SELECTIVELY EXTRACTING MAGNESIUM CHLORIDE HEXAHYDRATE FROM MAGNESIUM CHLORIDE HEXAHYDRATE BEARING MATERIALS IN SITU BY SOLUTION MINING

[75] Inventors: Charles A. R. Lambly; Irving Leibson, both of Alamo; Pierre J. Chassagne, San Mateo, all of Calif.

[73] Assignee: Bechtel International Corporation, San Francisco, Calif.

[22] Filed: May 23, 1975

[21] Appl. No.: 580,382

[52] U.S. Cl. ..... 299/4; 299/5

[51] Int. Cl.[2] ..... E21C 37/06; E21C 41/06

[58] Field of Search ..... 299/4, 5; 23/272 AH, 23/304, 300

[56] References Cited

UNITED STATES PATENTS

| | | | |
|---|---|---|---|
| 2,787,455 | 4/1957 | Knappen | 299/5 |
| 2,847,202 | 8/1958 | Pullen, Jr. | 299/4 |
| 3,442,553 | 5/1969 | Kutz | 299/4 |
| 3,498,674 | 3/1970 | Matthews | 299/4 |
| 3,833,709 | 9/1974 | Chassagne | 299/5 X |

FOREIGN PATENTS OR APPLICATIONS

| | | |
|---|---|---|
| 33,189 | 12/1964 | Germany |

*Primary Examiner*—Stephen J. Novosad
*Assistant Examiner*—George A. Suchfield
*Attorney, Agent, or Firm*—Townsend and Townsend

[57] ABSTRACT

A method of separating and removing magnesium chloride hexahydrate from deep subterranean salt formations containing magnesium chloride hexahydrate, such as a carnallite bed or a bischofite bed, wherein one or more holes are drilled or provided through an overburden and into the bed. A solvent formed from any one of the lower saturated monohydric aliphatic alcohols having 1 to 4 carbon atoms, such as methanol, is directed downwardly in the hole and into contact with the bed, then upwardly through and out of the cased hole. Magnesium chloride hexahydrate is dissolved selectively by the solvent, but other salts, such as potassium chloride and sodium chloride, remain substantially insoluble in the solvent. The insolubles may be elevated out of the hole simultaneously with the lifting of the solvent-magnesium chloride hexahydrate solution or subsequent to such lifting. The flow is continued until the solvent is sufficiently lean to warrant the discontinuance of recovery of magnesium chloride hexahydrate, at which time the operation can be terminated or a second phase operation can be undertaken in which the slurry comprised of the solvent and the insolubles in the cavity of the bed is removed from the hole by conventional techniques, such as pumping or gas lifting.

13 Claims, 4 Drawing Figures

METHOD FOR SELECTIVELY EXTRACTING MAGNESIUM CHLORIDE HEXAHYDRATE FROM MAGNESIUM CHLORIDE HEXAHYDRATE BEARING MATERIALS IN SITU BY SOLUTION MINING

BACKGROUND OF THE INVENTION

Solution mining of subterranean salt formations, such as carnallite beds or bischofite beds, has been performed in the past as a simple means of retrieving certain salts therein without having to face the problems associated with dry mining of such beds. Until now, aqueous solutions have been used for this purpose wherein water directed into a hole drilled into a bed forms a brine containing magnesium chloride, potassium chloride and sodium chloride and other soluble materials in solution. At saturation, the weight percentages of these three principal salts in the resultant aqueous brine are approximately 30% magnesium chloride, 3% potassium chloride and 10% sodium chloride.

When the above solution is lifted to the surface, it must be processed to separate the various salts from each other. This reqires considerable time and expense inasmuch as the brine must be processed by fractional crystallization techniques which are very costly to perform. Moreover, the latent heat of vaporization of water is approximately 1000 B.T.U. per pound so that considerable energy is expended in removing water from the salts and other solids in the brine in those climates where solar evaporation is impractical. Furthermore, because the saturation solubility of potassium chloride in the brine is relatively low (i.e., 3 wgt. %), aqueous solution mining is not the most practical way to obtain and utilize potassium chloride for potash.

In U.S. Pat. No. 3,833,709, a method is described for the recovery of magnesium chloride hexahydrate from carnallite ore subjecting the same to a solvent taken from the group comprised of the lower saturated monohydric aliphatic alcohols having 1 to 4 carbon atoms, such as methanol, ethanol, propanol, isopropyl alcohol, n-butyl alcohol, secondary-butyl alcohol, iso-butyl alcohol and tert-butyl alcohol. The solvent preferentially dissolves substantially only the magnesium chloride hexahydrate content of carnallite; thus, substantially none of the other salts are dissolved by the solvent and the resulting solution is extremely rich in magnesium chloride hexahydrate.

SUMMARY OF THE INVENTION

The present invention is directed to a method for the solution mining of subterranean magnesium chloride hexahydrate bearing material in situ and for the separation of magnesium chloride hexahydrate values of the subterranean materials from insolubles initially contained therein. To this end, a solvent taken from any of the above-mentioned alcohols is directed into a hole drilled into a bed, such as a carnallite or bischofite bed, below an overburden. The solvent contacts the materials of the bed and magnesium chloride hexahydrate passes into solution, causing part of or substantially all of the other salts or insolubles to settle in the solvent to the bottom of the hole as slimes or residues, depending upon the volume rate of flow of the solvent through the hole.

The solvent is caused to rise in the hole to an outlet by the continuous adding of solvent to the top of the hole to cause a flow of solvent along a path extending downwardly through the hole to the bottom thereof and then upwardly through the outlet. The rate of flow can either be fast, slow or intermittent. If a fast rate is selected, the solvent with the magnesium chloride hexahydrate dissolved therein will simultaneously carry some of the insolubles upwardly therewith as a slurry. At the surface, the insolubles are filtered from the solvent before the magnesium chloride hexahydrate is recovered.

If the flow rate is slow, there will be maximum solubilization of the magnesium chloride hexahydrate with minimum entrainment of the insolubles as a slurry in the rising solution. This controls the volume of the insolubles that are elevated to thereby assure removal from the hole of the solution with essentially only the magnesium chloride hexahydrate dissolved therein and carried thereby. The insolubles will remain in the cavity of the bed as a slurry in the solvent. When the level of the magnesium chloride hexahydrate in the solution decreases to a value at which further solution mining of the magnesium chloride hexahydrate is deemed impractical or uneconomical, the slurry of insolubles and solvent in the cavity of the bed is forced or pumped out of the hole so that it can be processed to separate the solvent and the various insolubles from each other.

As soon as the slurry has been removed from the cavity, the latter can provide a storage region for fluid or solid materials which do not dissolve or otherwise affect the materials of the bed. For instance, oil, natural gas and other such fluids or solids can economically be stored in this storage region.

The solution mining method of the present invention is vastly superior to conventional aqueous solution mining techniques because of the in situ separation of the magnesium chloride hexahydrate from the magnesium chloride hexahydrate bearing formation. The magnesium chloride hexahydrate methanol solution formed in situ is very low in content of dissolved impurities, such as potassium chloride and sodium chloride, because of the selectivity of the solvent for magnesium chloride hexahydrate. For carnallite ores, the magnesium chloride hexahydrate-methanol solution has a typical ratio of the weight percentage of magnesium chloride to that of potassium chloride of 300 to 1. This is to be contrasted with a ratio of 10 to 1 obtained with aqueous solution techniques. Also, the slurry obtained from a carnallite ore in this phase of the operation of the present invention is a much richer source of potassium chloride than the brine of the aqueous solution techniques. Thus, the present method renders the recovery of both magnesium chloride hexahydrate and potash economical.

The primary object of this invention is to provide a method of recovering magnesium chloride hexahydrate from a carnallite bed or other magnesium chloride hexahydrate bearing bed by selectivity solution mining the same in situ with a solvent of the group of the lower saturated monohydric aliphatic alcohols having 1 to 4 carbon atoms in a manner to assure that the magnesium chloride hexahydrate will readily pass into solution and can be elevated to a surface processing station to allow separation of the magnesium chloride hexahydrate from the solvent.

Another object of the present invention is to provide a method as set forth above wherein the insolubles of the bed can be lifted simultaneously with the magnesium chloride hexahydrate-methanol solution. As an alternative option, the insolubles of the bed can remain in the bed or be lifted subsequently, depending upon the flow rate of the solvent through the cavity in the bed.

A further object of this invention is to provide a method of the type described wherein a solvent of the group of lower saturated monohydric aliphatic alcohols having 1 to 4 carbon atoms is directed at a slow rate through a pipe in a hole drilled into a carnallite bed below an overburden so that the solvent forms a quiet, peaceful flow through the hole in the carnallite bed to cause the magnesium chloride content thereof to be selectively dissolved and to rise therewith to an outlet near the top of the hole while the insolubles will remain in the bed cavity as slimes or slurry for subsequent removal with the solvent after selectively solution mining of the magnesium chloride hexahydrate has been completed.

Another object of this invention is to provide a method of the aforesaid character wherein the flow rate of the solvent is relatively fast so that the insolubles can be carried as a slurry to the surface by the solvent during selectively solution mining of magnesium chloride hexahydrate.

Other objects of the invention will become apparent as the following specification progresses, reference being had to the accompanying drawings for an illustration of the sequence of operation of the present method.

Figure 1:
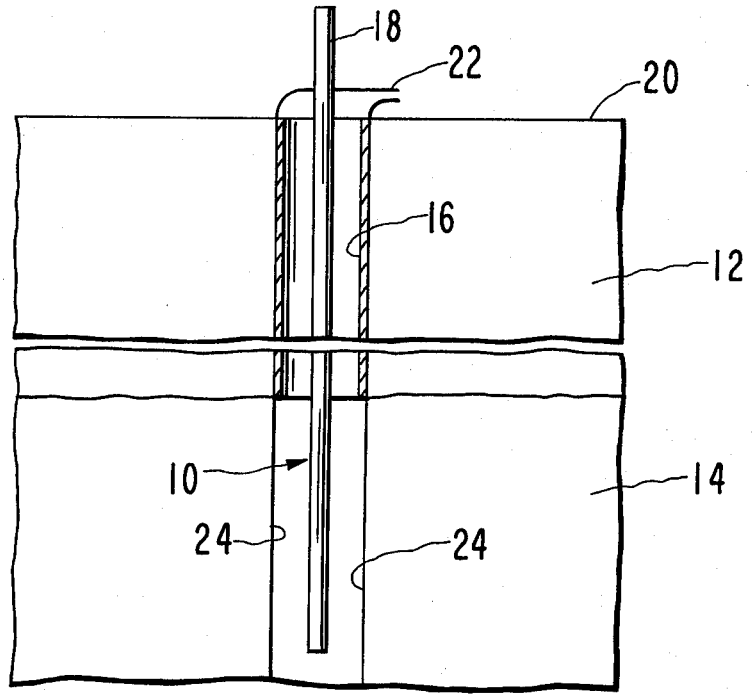
FIG. 1 is a schematic view showing a bed containing magnesium chloride hexahydrate below an overburden, and a hole drilled through the overburden into the bed, there being a liquid feed tube extending into the hole to the bed.
Figure 2:
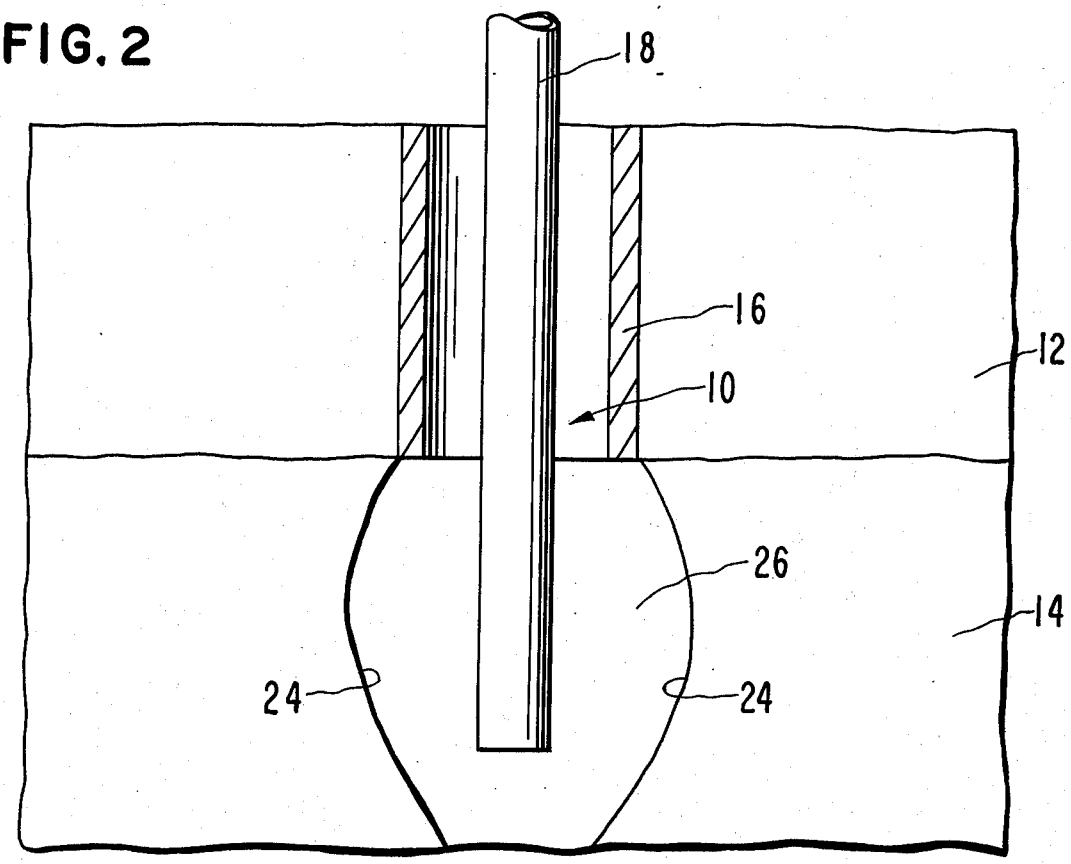
FIG. 2 is a view similar to FIG. 1, but on an enlarged scale and showing the way in which a solvent is directed by means of the feed tube into the bottom of the hole and further illustrating the way in which the hole commences to become larger to for a cavity when the magnesium chloride hexahydrate of the bed selectively dissolves in the solvent.
Figure 3:
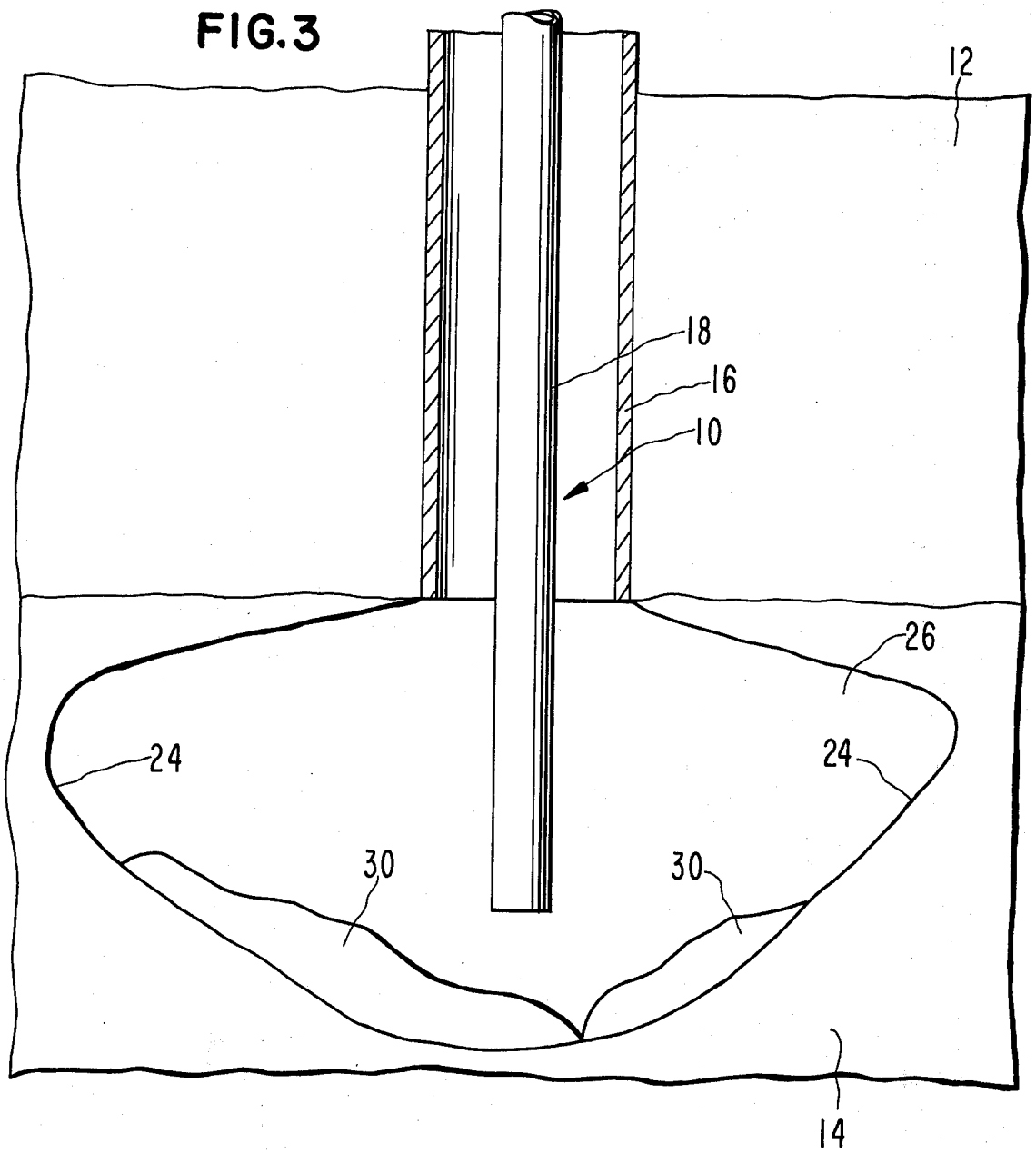
Figure 4:
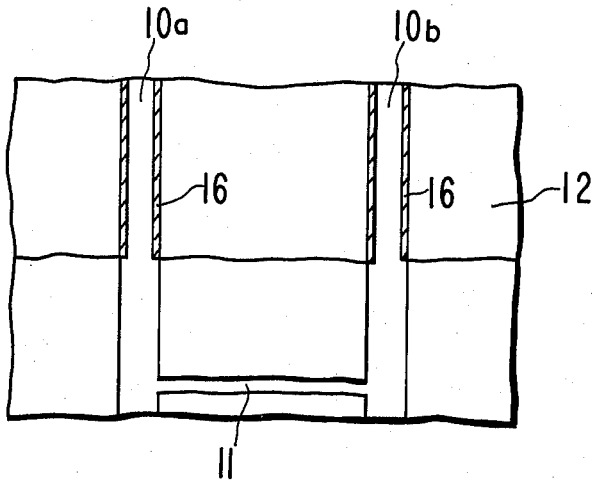

FIG. 3 illustrates a view similar to FIG. 2, but showing a view of the cavity after it has been sufficiently enlarged to a size in which the magnesium chloride hexahydrate removal by solution mining has been substantially completed; and FIG. 4 is a view similar to FIG. 1, but showing a plurality of holes for selectively solution mining magnesium chloride hexahydrate from a bed containing magnesium chloride hexahydrate.

In carrying out the present method of selectively solution mining of magnesium chloride hexahydrate in situ and the separation of magnesium chloride hexahydrate from other salts and/or impurities in situ, a generaly circular hole (FIG. 1) is drilled or otherwise provided through an overburden 12 of rock and other materials and into a bed 14 of carnallite, bischofite or other magnesium chloride hexahydrate bearing material. For purposes of illustration only, bed 14 will be considered a carnallite bed. The hole is of sufficient size and depth to inersect the bed.

The portion of the hole through the overburden is provided with a casing 16 and a liquid feed pipe 18 is inserted into the hole and into the carnallite bed 14. For purposes of illustration, the lower end of the pipe terminates near the bottom of bed 14 although the pipe could terminate at any location in the carnallite bed. The upper end of pipe 18 is typically above the surface 20 of the overburden 12 so as to provide a head for liquid placed in the pipe. The pipe and the annular area of the hole act as a U-tube as to a fluid therein. In the alternative, the upper end of pipe 18 can be near surface 20 and pumping means can be provided to direct a liquid flow through pipe 18 and into the hole.

An alcohol is directed down pipe 18 and into the bottom of hole 10 to cause the magnesium chloride hexahydrate of carnallite bed 14 to go into solution and to leave essentially all of the potassium chloride, sodium chloride and other salts and insoluble materials as insoluble residues or slimes in the bottom of the hole. As the hole enlarges, it forms a cavity 26 (FIGS. 2 and 3).

The solvent is selected from the group comprising the lower saturated monohydric alphatic alcohols having 1 to 4 carbon atoms, such as methanol, ethanol, propanol, isopropyl alcohol, n-butyl alcohol, secondary-butyl alcohol, iso-butyl alcohol and tert-butyl alcohol. For purposes of illustration, the description hereinafter will be made with respect to methanol although it is to be understood that the present method can be carried out with any of the other aforementioned alcohols.

When the methanol is directed into the bottom of the hole, sufficient methanol is used to fill the hole. The rate at which methanol is directed into pipe 18 can be controlled so as to be relatively slow, relatively fast or intermittent. If relatively slow, it will be such as to cause a quiet, peaceful flow, downwardly in the pipe, through cavity 26, and then upwardly through the annular portion around pipe 18. The methanol-magnesium chloride hexahydrate solution will rise to the top of the casing 16 as shown in FIG. 1 and will pass out of the hole through a suitable conduit 22 at or near surface 20; whereby the solution is collected and then directed to processing apparatus to separate the magnesium chloride hexahydrate-methanol solution from the insolubles before recovering the magnesium chloride hexahydrate from the solution.

If the flow rate of the solvent is relatively fast, the slimes or insolubles are raised to the surface simultaneously with the magnesium chloride hexahydrate-methanol solution. Such insolubles are filtered at the surface from such solution prior to recovery of the magnesium chloride hexahydrate therefrom.

The methanol directed into the bottom of the hole contacts the adjacent surfaces 24 of the carnallite in bed 14. The flow of methanol is substantially continuous and, since methanol selectively dissolves magnesium chloride hexahydrate, bed 14 will begin to wear away as the magnesium chloride hexahydrate content thereof passes into solution with the methanol. If the solvent flow rate is relatively slow, substantially all of the slimes formed by other salts will remain in the cavity. The methanol then, as it rises in the hole, carries therewith the magnesium chloride hexahydrate in solution substantially free of impurities and the solution is removed at the upper end of casing 16 as described above. The methanol is saturated or partly saturated with magnesium chloride hexahydrate before the solution passes out of the open top of casing 16. This process is continued until the solution contains magnesium chloride hexahydrate at a level which is deemed uneconomical for further solution mining purposes of it.

If the slow flow rate has been used, the insolubles and methanol remaining in cavity 26 will be raised by suitable means, such as pumping or gas lifting, to the surface as soon as the concentration of magnesium chloride hexahydrate in methanol has reached a sufficiently low value to be considered uneconomic for further solution mining.

FIG. 2 illustrates the way in which the cavity 26 formed in carnallite bed 14 commences to enlarge as the magnesium chloride hexahydrate passes into solution with the methanol. The cavity is shown in FIG. 2 as being slightly conical. Eventually, the size of the hole increases as shown in FIG. 3.

When one area of the carnallite bed has been depleted, a similar process can then be carried out at an adjacent area thereof. To this end, a hole will be drilled into the carnallite bed as described above at the adjacent area and solution mining can commence and be carried out in such other hole. Also, a number of such holes can be mined simultaneously according to the technique of the present invention, it being desirable to assure substantially no collapse of the overburden; thus, care will generally be taken to assure that the spacing between adjacent holes 10 and size of the cavities 26 formed by the solution mining of the present invention are such that there will be no collapse of the overburden.

Instead of a single hole 10 and pipe 18 therein, a plurality of holes 10*a* and 10*b* (FIG. 4) can be drilled into bed 14 and a fracture line 11 can be formed therein in accordance with conventional mining techniques. The holes will be cased in the portion through the overburden. One or more holes may be used to direct methanol to bed 14 and one or more of the other holes may be used to receive the upward flow of solution to conduit 22.

At the surface, the saturated or partly saturated methanol containing magnesium chloride hexahydrate is filtered and then treated to recover the methanol for recirculation as a solvent. The separated magnesium chloride hexahydrate and the insolubles are also processed separately. For instance, the magnesium chloride hexahydrate may be calcined to reduce the waters of hydration to the dihydrate. The magnesium chloride dihydrate is then in a form usable for further processing in the production of magnesium. The insolubles may be processed to marketable products, such as potash.

In a further aspect of the invention, each empty cavity 26 in bed 14 can be used for the storage of gas, oil or other fluid or solid materials that will not dissolve the carnallite or salt walls of the cavity. In carrying out the method of the present invention, the magnesium chloride hexahydrate bearing beds are considered to be substatially impervious.

The present invention, therefore, provides an efficient method for selectively extracting magnesium chloride hexahydrate from a subterranean salt bed in situ by solution mining. The magnesium chloride hexahydrate produced is of very high quality having a very low content of impurities, such as boron, critical in the further processing and manufacture of magnesium metal and refractories.

We claim:

1. A method for the selective, in situ extraction of magnesium chloride hexahydrate from a subterranean bed containing magnesium chloride hexahydrate comprising: filling a hole in a subterranean bed containing magnesium chloride hexahydrate with a solvent to cause it to flow and contact the bed materials and to dissolve the magnesium chloride hexahydrate thereof with said solvent being taken from the group of the lower saturated monohydric aliphatic alcohols containing 1 to 4 carbon atoms; flowing the solvent with magnesium chloride hexahydrate dissolved therein from the bed; and recovering at least portions of the solvent and the insolubles originally in the bed.

2. A method as set forth in claim 1, wherein the rate of said solvent flow is controlled to provide maximum solubilization of the magnesium chloride hexahydrate in said solvent and minimum entrainment of insolubles in the solvent, said recovery step being performed subsequent to said flowing step.

3. A method as set forth in claim 1, wherein the rate of said solvent flow is controlled to cause entrainment of the insolubles in said solvent solubilized with magnesium chloride hexahydrate, said recovering step being performed simultaneously with said flowing step.

4. A method as set forth in claim 1, wherein the solvent flow is intermittent.

5. A method for the selective, in situ extraction of magnesium chloride hexahydrate from a subterranean bed containing magnesium chloride hexahydrate comprising: providing two paths extending between a region of the bed and a location thereabove; providing a solvent comprised of a lower saturated monohydric alphatic alcohol having from 1 to 4 carbon atoms; directing the solvent downwardly from said location into the bed region along one path and then upwardly along the other path to cause the solvent to flow and contact the materials in said bed region and to dissolve the magnesium chloride hexahydrate thereof; and moving the solvent with the magnesium chloride hexahydrate dissolved therein from said bed region.

6. A method as set forth in claim 5, wherein the rate of flow of said solvent in the hole is relatively slow and is sufficient to cause maximum solubilization of magnesium chloride hexahydrate with minimum entrainment of the insolubles in the solvent; an including the step of lifting the insolubles from said bed after the moving step.

7. A method as set forth in claim 5, wherein is included the steps of separating the solvent from the magnesium chloride hexahydrate dissolved therein after said moving step, and recirculating the solvent to a hole in a bed containing magnesium chloride hexahydrate.

8. A method as set forth in claim 5, wherein the solvent flow is intermittent.

9. A method as set forth in claim 5, wherein the flow rate of said solvent is relatively fast and is sufficient to cause entrainment of insolubles in the solvent for transit thereby from said bed region.

10. A method for the selective, in situ extraction of magnesium chloride hexahydrate from a subterranean bed disposed below an overburden and containing magnesium chloride hexahydrate and other salts comprising: providing a hole through the overburden and into a region of the bed; forming a confined path in hole from the surface of the overburden to said bed region; directing a solvent into the hole along said confined path and into contact with the materials of the bed with the solvent being of a lower saturated monohydric aliphatic alcohol having from 1 to 4 carbon atoms so that the magnesium chloride hexahydrate will dissolve in said solvent and the other salts and insoluble materials will be substantially insoluble therein; continuing to direct the solvent downwardly into the hole to cause a flow of the solvent upwardly through the hole about said confined path to the surface of the overburden with the flow being at a rate sufficient to maximize the solubility of magnesium chloride hexahydrate and to minimize the entrainment of the other salts and insoluble materials in the solvent flow, whereby the other salts will remain in said bed region as slimes; removing the solvent with the magnesium chloride hexahydrate dissolved therein from the hole at the surface until the concentration of magnesium chloride hexahydrate in the solvent decreases to a predetermined value; and forcing the slimes as a slurry with the solvent out of said hole to the surface when said concentration has decreased to said predetermined value.

11. A method as set forth in claim 10, wherein said solvent is methanol.

12. A method for the selective, in situ extraction of magnesium chloride hexahydrate from a subterranean bed disposed below an overburden and containing magnesium chloride hexahydrate and other salts comprising: providing a hole through the overburden and into a region of the bed; forming a confined path in the hole from the surface of the overburden to said bed region; directing a solvent into the hole along said confined path and into contact with the materials of the bed with the solvent being of a lower saturated monohydric aliphatic alcohol having from 1 to 4 carbon atoms so that the magnesium chloride hexahydrate will dissolve in said solvent and the other salts and insoluble materials will be substantially insoluble therein; continuing to direct the solvent downwardly into the hole along said confined path to the surface of the overburden with the flow being at a rate sufficient to cause the entrainment of the other salts and insoluble materials as slimes in the solvent flow when the concentration of the magnesium chloride hexahydrate dissolved in the solvent is above a predetermined value; removing the solvent with the magnesium chloride hexahydrate dissolved therein from the hole at the surface until the concentration of magnesium chloride hexahydrate in the solvent decreases to said predetermined value; and forcing the remaining solvent and other salts out of said hole.

13. A method as set forth in claim 12, wherein said solvent is methanol.

* * * * *